United States Patent [19]

Kirk, Jr.

[11] 4,154,374

[45] May 15, 1979

[54] FINGER OPERATED SPRAY PUMP

[75] Inventor: Donald C. Kirk, Jr., Naugatuck, Conn.

[73] Assignee: Ethyl Products Company, Baton Rouge, La.

[21] Appl. No.: 838,654

[22] Filed: Oct. 3, 1977

[51] Int. Cl.[2] ..... B67D 5/42

[52] U.S. Cl. ..... 222/321; 222/385; 239/333

[58] Field of Search ..... 222/320, 321, 383, 385; 239/331, 333, 349; 60/591

[56] References Cited

U.S. PATENT DOCUMENTS

| | | | |
|---|---|---|---|
| 3,877,616 | 4/1975 | Stevens | 222/321 |
| 3,907,174 | 9/1975 | Steiman | 222/321 |
| 3,923,250 | 12/1975 | Boris | 222/321 |
| 3,933,279 | 1/1976 | Maier | 239/349 |

*Primary Examiner*—Robert J. Spar
*Assistant Examiner*—H. Grant Skaggs
*Attorney, Agent, or Firm*—Donald L. Johnson; John F. Sieberth; David L. Ray

[57] ABSTRACT

A finger-operated spray pump assembly including a tank, a primary piston slidably fitted inside the tank, a secondary piston slidably fitted inside the primary piston, and a spring fitted inside the primary piston and on the outside of the secondary piston for biasing the primary piston away from the secondary piston.

6 Claims, 3 Drawing Figures

FINGER OPERATED SPRAY PUMP

BACKGROUND OF THE INVENTION

The present invention relates to liquid atomizer pumps. In particular, the invention relates to small hand-held, finger-operated dispensers involving pump assemblages as distinguished from pressurized aerosol containers and valves.

Pumps of the type with which the present invention is concerned includes a piston arranged to be driven into the pump housing against a spring pressure so as to deliver the liquid to the nozzle. It is known that in order to obtain the highest possible degree of atomization it is preferable to provide at the pump outlet a so-called turbulence nozzle.

However, it has been found that even the use of a nozzle of this type in prior art atomizing pumps does not completely preclude the occurrence of an insufficient atomization and the formation of droplets in the vicinity of the nozzle, particularly when the pump is subjected to a relatively slow depression movement.

U.S. Pat. No. Re. 28,366, reissued Mar. 18, 1975, to Pechstein discloses an atomizing pump which has as its object the elimination of some of these drawbacks. The Pechstein patent discloses a pump that has a first piston and a second piston, the first piston having a liquid flow passage. A valve which moves relative to the first piston and the second piston is disposed for closing a liquid flow passage in the first piston.

SUMMARY OF THE INVENTION

In accordance with the present invention, there is provided a finger-operated spray pump assembly including a tank, a primary piston slidably fitted inside the tank, a secondary piston slidably fitted inside the primary piston, and a spring fitted inside the primary piston and on the outside of the secondary piston for biasing the primary piston away from the secondary piston.

DESCRIPTION OF THE PREFERRED EMBODIMENTS

Figure 1:
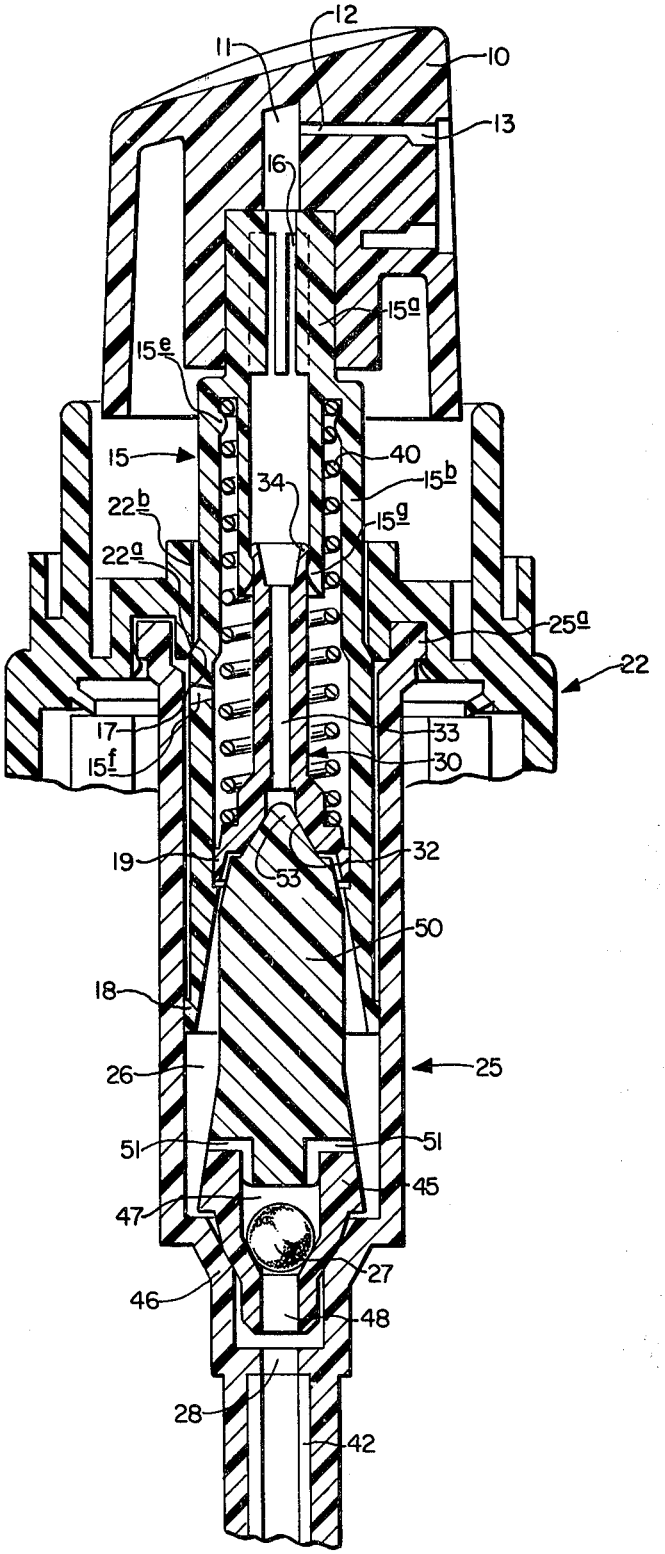
FIG. 1 is an enlarged fragmentary sectional view showing details of the pump.

Referring now to the drawings, the spray pump assembly of the present invention can be seen in FIG. 1 to include a tank, which is generally indicated by the numeral 25. Tank 25 houses a primary piston, generally indicated by the numeral 15. Tank 25 is generally cylindrical in shape as is primary piston 15 and secondary piston 30.

At the bottom of tank 25 is non-return valve 27 and liquid inlet channels 28. Non-return valve 27 is preferably a metal ball as is shown in the photographs but other conventional non-return valves may be utilized.

Non-return valve 27 is held within valve housing 45 which is generally cylindrical in shape and rests against the lower shoulders 46 of tank 25. Non-return valve 27 is contained within a cylindrical cavity 47 molded into valve housing 45. Also located in the end of valve housing 45 is a cylindrical channel 48 which is aligned with dip tube 42 located in the lower end of tank 25.

Force-fitted in the upper end of valve housing 45 is piston seat 50. Piston seat 50 has a plurality of channels 51 at the bottom which communicate with cylindrical cavity 47. Piston seat 50 is a generally solid cylindrical member which, at its upper end, forms a liquid-tight seal with the lower end of secondary piston 30 when in the positions shown in FIGS. 1 and 3. The upper end 53 of piston seat 50 is cone shaped and adapted for sealing with the sloping inner walls 32 of the lower end of secondary piston 30.

A compression chamber 26 is defined by the space between the lower end of tank 25, the lower end of primary piston 15, and the outside seat 50 and valve housing 45. Chamber 26 also includes channels 51 and the portion of cavity 47 above ball 27.

Primary piston 15 is slidably contained within tank 25 by means of the closure, generally indicated by the numeral 22, which is fitted to the top of the container by crimping, screwing, or the like. Closure 22 limits the upward movement of primary piston 15 when shoulder 17 of primary piston 15 strikes shoulder 22*a* of closure 22. Tank 25 is connected to closure 22 by flange 25*a* which is held to closure 22 by shoulder 25*b*.

Primary piston 15 is generally hollow inside and has a hollow stem 15*a* which projects upwardly therefrom. Stem 15*a* contains a liquid channel 16 which communicates with liquid channel 33 in secondary piston 30.

Primary piston 15 also contains an intermediate portion 15*b* which is slidably received in circular opening 22*b* in closure 22. A hollow cylindrical guide 15*d* extends downwardly in the interior of primary piston 15 and is adapted to slidably receive secondary piston 30. A spring 40 is located between the inside of intermediate portion 15*b* and the outside of cylindrical guide 15*d*. Spring 40 is held in place by shoulder 15*e* located on the inside wall of intermediate portion of primary piston 15.

A vent 15*f* is located in the side wall of primary piston 15 to permit air to flow freely from the interior of portion 15*b* to the exterior of primary piston 15 and the interior of tank 25. A conventional vent (not shown) may also be located in the upper portion of tank 25 to permit air to flow freely from the interior of tank 25 to the interior of the container.

Primary piston 15 has located at the lower end thereof a scaling collar 18 which forms a sliding seal with the interior of tank 25, and secondary piston 30 has a scaling collar 19 located at the lower end thereof which makes a sliding seal with the interior of pirmary piston 15. The upper end of piston 30 has a scaling collar 34 which forms a sliding seal with the interior of cylindrical guide 15*d*. A liquid channel 33 is located inside piston 30. Secondary piston 30 is prevented from wobbling within cylindrical guide 15*d* by shoulder 15*g* located on the interior of cylindrical guide 15*d*.

Attached at the top of stem 15*a* is actuator button 10. Actuator button 10 has a vertical channel 11 which communicates with channel 16 and a horizontal channel 12 which communicates with channel 11. Communicating with channel 12 is opening 13 into which may be placed any conventional atomizing nozzle (not shown) for receiving and spraying liquid pumped through the pump assembly.

Figure 2:
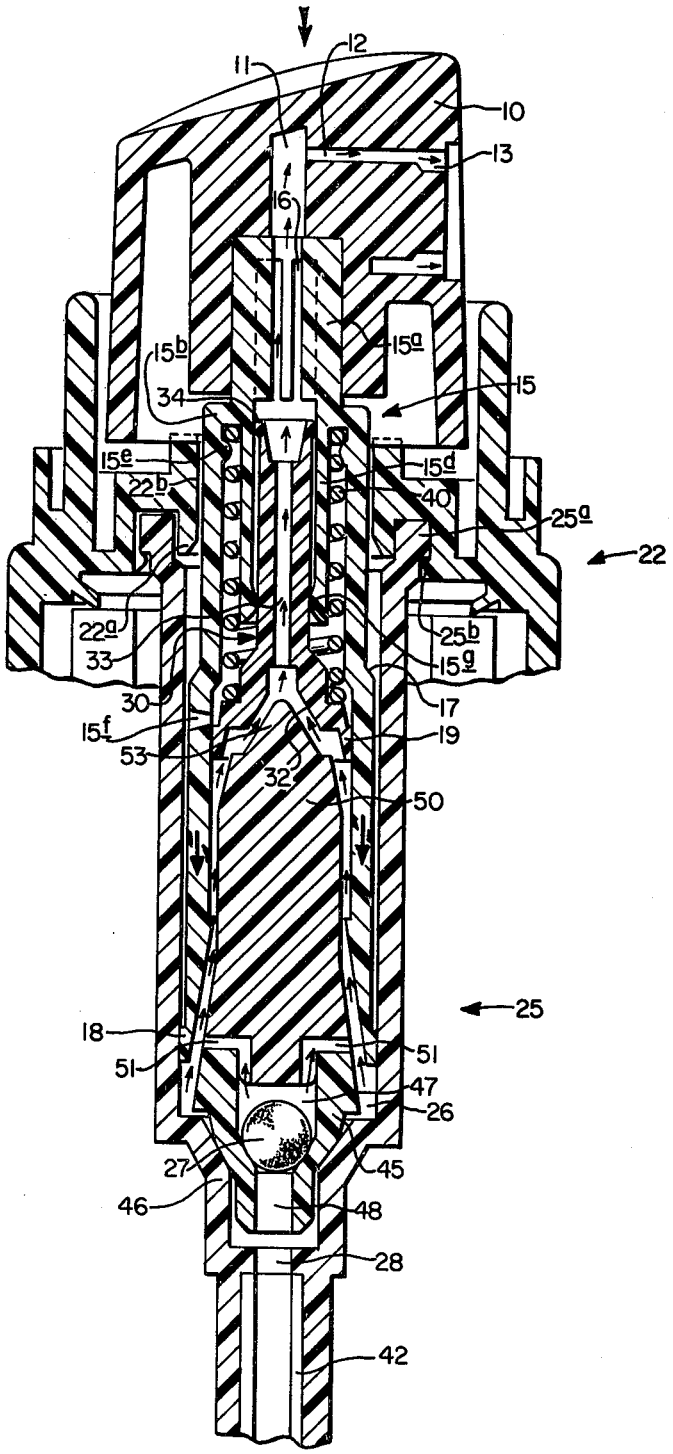
FIG. 2 is an enlarged fragmentary sectional view of the pump as the primary piston is being depressed; and, FIG. 3 is an enlarged fragmentary sectional view of the pump as the primary piston is rising.

In the free standing normal postion shown in FIG. 1, the spring 40 forces secondary piston 30 onto the upper end 53 of piston seat 50. In operation, the actuator button 10 is first depressed, moving primary piston 15 downwardly and compressing spring 40. As piston 15 moves downwardly, the liquid trapped in compression chamber 26 is placed under increasing pressure, which keeps valve 27 closed as shown in FIG. 2.

At a certain point during the downward travel of piston 15, the pressure on the liquid within compression chamber 26 reaches a point sufficient to overcome the spring pressure being exerted downwardly on secondary piston 30. At this point, secondary piston 30 begins to travel upward due to the upward force exerted against scaling collar 19 by the liquid in the compression chamber 26. When secondary piston 30 moves upwardly liquid begins to flow as indicated by the arrows in FIG. 2 from the interior of primary piston 15 upwardly through channels 33, 16, 11, 12, and 13, to a conventional atomizing nozzle (not shown) which can be fitted in opening 13. Once a sufficient pressure drop caused by the escape of liquid is obtained, the secondary piston 30 is forced by the spring against seat 50 as shown in FIG. 3 to stop the liquid flow from compression chamber 26.

Figure 3:
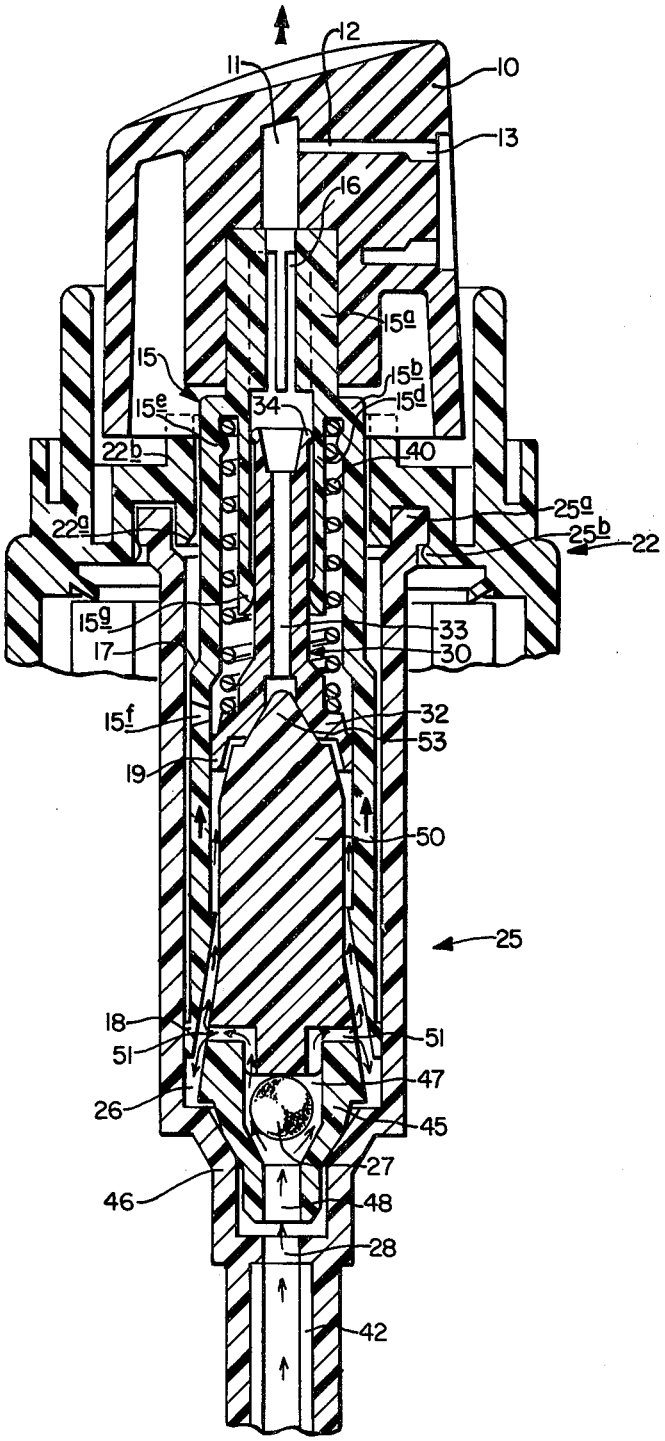

In FIG. 3, actuator button 10 is shown moving upwardly by spring pressure. The reduced pressure within compression chamber 26 caused by the upward movement of primary piston 15 draws liquid upwardly as indicated by the arrow through suction tube 42 and inlet 28 upward through channel 48, around valve 27, through channels 51, into tank 25, thus filling tank 25 with a new charge of liquid.

Having fully described the invention it is desired that it be limited only within the spirit and scope of the attached claims.

What is claimed:

1. A finger-operated spray pump assembly comprising:

a. tank means;

b. primary piston means slidably fitted in said tank means, said primary piston means being hollow inside and adapted for conveying liquid therethrough, said primary piston means having an annular scaling collar means for forming a seal with the inner wall of said tank means;

c. secondary piston means slidably fitted in said primary piston means, said secondary piston means being hollow inside and adapted for conveying liquids therethrough, said secondary piston means having an annular scaling collar means for forming a seal with the inner wall of said primary piston means;

d. seat means located in said tank means for contacting and forming a liquid-tight seal with said secondary piston means;

e. valve means connected to said seat means, said valve means being adapted to prevent the back flow of liquid from said tank means and to permit liquids to enter said tank means; and, f. resilient means fitted inside said primary piston means and outside said secondary piston means for biasing said primary piston means away from said secondary piston means.

2. The pump assembly of claim 1 wherein said tank means has an internal cross-sectional area in a plane perpendicular to the directional movement of said primary piston means.

3. The pump assembly of claim 2 wherein said primary piston means and said secondary piston means are coaxially disposed for movement in the opposite direction.

4. The pump assembly of claim 1 wherein said primary piston means has cylindrical guide therein for slidably receiving said secondary piston means.

5. The pump assembly of claim 4 wherein said resilient means comprises a spring slidably received on the outside of said cylindrical guide.

6. The pump assembly of claim 1 wherein said resilient means is a spring.

* * * * *